US007815327B2

(12) United States Patent
Shamshoian

(10) Patent No.: US 7,815,327 B2
(45) Date of Patent: Oct. 19, 2010

(54) INTEGRATED LIGHT FIXTURE AND VENTILATION MEANS

(76) Inventor: Gary Peter Shamshoian, 18765 Tuggle Ave., Cupertino, CA (US) 95014

( * ) Notice: Subject to any disclaimer, the term of this patent is extended or adjusted under 35 U.S.C. 154(b) by 54 days.

(21) Appl. No.: 11/520,437

(22) Filed: Sep. 12, 2006

(65) Prior Publication Data

US 2007/0091591 A1 Apr. 26, 2007

Related U.S. Application Data

(60) Provisional application No. 60/716,045, filed on Sep. 12, 2005.

(51) Int. Cl.
*F21V 29/02* (2006.01)

(52) U.S. Cl. ..... 362/96; 362/149; 362/218; 454/293

(58) Field of Classification Search ..... 362/96, 362/149, 218, 373; 454/293
See application file for complete search history.

(56) References Cited

U.S. PATENT DOCUMENTS 2,526,828 A * 10/1950 Phillips ..... 362/149
2,564,334 A * 8/1951 Kennedy ..... 454/293
2,962,582 A * 11/1960 Croft ..... 362/149
2,991,708 A 7/1961 Falk et al.
3,051,073 A 8/1962 Kennedy
3,125,943 A * 3/1964 Geocaris et al. ..... 454/293
3,173,616 A * 3/1965 Lipscomb ..... 454/293
3,187,660 A * 6/1965 Lazerson ..... 454/293
3,309,502 A * 3/1967 Witherspoon, Jr. ..... 362/149
3,403,614 A 10/1968 Carnes
3,409,766 A * 11/1968 Gershon ..... 454/293
3,693,530 A * 9/1972 Larkfeldt et al. ..... 454/294
3,788,206 A * 1/1974 Mulvey ..... 454/293
3,841,393 A * 10/1974 Gilles ..... 454/294
4,231,513 A * 11/1980 Vance et al. ..... 454/299
4,238,815 A 12/1980 Price
4,293,895 A 10/1981 Kristofek
4,333,750 A 6/1982 Helmus et al.
4,439,816 A 3/1984 Litchfield
4,449,166 A 5/1984 Sharp
4,461,205 A 7/1984 Shuler
4,508,022 A * 4/1985 Finkelstein et al. ..... 454/299
4,603,618 A 8/1986 Soltis
4,716,504 A 12/1987 Pahl et al.
4,776,263 A * 10/1988 Lokander et al. ..... 454/293
5,038,256 A 8/1991 Burkarth
5,136,486 A 8/1992 Burkarth (Continued)

OTHER PUBLICATIONS

International Preliminary Report on Patentability and International Search Report issued on Mar. 21, 2008 in PCT/US2006/035756.

*Primary Examiner*—Ismael Negron
(74) *Attorney, Agent, or Firm*—Buchanan Ingersoll & Rooney PC

(57) ABSTRACT

A ceiling mounted fixture, which includes at least one longitudinal arrangement of at least one air vent adapted to receive an air supply, and at least two longitudinal arrangements of at least one light source. The at least one longitudinal arrangement of at least one air vent is positioned between the at least two longitudinal arrangements of light sources. The fixture also includes a plenum with an airflow guide adapted to receive the air supply from the at least one longitudinal arrangement of at least one air vent.

21 Claims, 4 Drawing Sheets

U.S. PATENT DOCUMENTS 5,161,878 A 11/1992 Degelmann et al.
5,297,326 A * 3/1994 Kline ..... 454/292
5,313,375 A 5/1994 Jones
5,313,759 A 5/1994 Chase, III
5,417,610 A * 5/1995 Spransy ..... 454/187
5,453,049 A 9/1995 Tillman, Jr. et al.
5,454,756 A * 10/1995 Ludwig ..... 454/293
5,688,042 A * 11/1997 Madadi et al. ..... 362/240
5,758,959 A 6/1998 Sieczkowski
5,857,766 A 1/1999 Sieczkowski
5,865,674 A 2/1999 Starr
5,902,035 A 5/1999 Mui
5,934,786 A 8/1999 O'Keefe
6,004,011 A 12/1999 Sieczkowski
6,033,085 A 3/2000 Bowker
6,390,913 B1 * 5/2002 Wieschermann et al. .... 454/294
6,592,237 B1 7/2003 Pledger
6,762,562 B2 * 7/2004 Leong ..... 315/51
6,787,999 B2 9/2004 Stimac et al.
6,871,983 B2 3/2005 Jacob et al.
2003/0102810 A1 * 6/2003 Cross et al. ..... 315/74
2004/0012959 A1 * 1/2004 Robertson et al. ..... 362/247
2004/0050077 A1 * 3/2004 Kasai et al. ..... 454/292
2006/0193131 A1 * 8/2006 McGrath et al. ..... 362/227

* cited by examiner

INTEGRATED LIGHT FIXTURE AND VENTILATION MEANS

CROSS-REFERENCE TO RELATED APPLICATIONS

This application claims priority to U.S. Provisional Patent Application No. 60/716,045, filed Sep. 12, 2005, which is incorporated herein by reference in its entirety.

FIELD OF THE INVENTION

The present invention relates to an integrated laboratory light fixture, which combines a light, an air vent, and other device fixtures for use in a suspended ceiling grid or Sheetrock® (e.g. drywall or plaster wallboard) system, and more particularly to an integrated laboratory light fixture design that promotes safety in facilities with critical airflow pattern requirements (such as labs, pharmaceutical, food, medical and healthcare applications), and reduces facility capital, energy and operating costs.

BACKGROUND OF THE INVENTION

Suspended ceiling systems are extensively used throughout the construction industry, both in new building construction and in the renovation of older buildings. A suspended ceiling consists of a grid-like support base suspended from the overhead structure, the base supporting a layer of ceiling panels. In addition, the suspended grid frequently serves as a support base for lighting fixtures and heating and air conditioning outlets, fire sprinklers, sensors, detectors, monitors, enunciators, speakers, and other such items. Ceiling space constraints often create difficult choices in controlled environment facilities because of competition for the optimum air outlet locations. Whenever hoods or containment devices are lined up at the room perimeter, the best air outlet locations are in the center, which is often where the benchtops and lighting are needed. The competition for space with lighting and other ceiling devices may lead to imperfect air outlet locations and potentially undesirable large scale airflow patterns (eddies). Many times the dynamic controls for the room HVAC (heating, ventilating and air-conditioning) system contributes to variable large scale airflow eddies which decrease the containment efficiency of hoods and other exhausted devices. These eddies create cross drafts that impair proper hood functioning. Usually, cross drafts require hood performance enhancements through increased exhaust and supply air flow rates, which lead to increases in energy costs. The design engineers must address all of these concerns, but the equipment available today does not lead to easy solutions. Once these considerations are addressed in high tech facilities, much of the ceiling tiles are no longer removable because of the devices rigidly mounted in them. This leads to difficult compromises that impair above ceiling access and facility maintenance operations.

There have been several past combination lighting and HVAC fixtures, but most applications have been intended for ceiling mounted clean room filtration. These inventions do not address the safety issues of hazardous compound containment devices (hoods and other exhausted cabinets) by promoting uniform room scale airflow patterns and minimizing cross drafts. In addition, the energy efficiency of the lighting and airflow control has not been combined in other products currently available. A fixture with a design focused on recyclability and is made from mostly recycled materials is not available today, but is needed in Green Building applications.

SUMMARY OF THE INVENTION

The present invention has as an underlying objective, the improvement of controlled environment facility safety while improving life cycle facility costs. The integrated laboratory light fixture (or "lablight") resolves the problem of competition for the ceiling space in the center of facilities with containment devices along the perimeter walls. In doing so, the capital costs of ceiling mounted equipment and associated installation costs are reduced. The operating cost of the facility is minimized by preventing hood airflow increases to resolve cross draft problems. Also, facility reliability enhancements come from improved above ceiling access inherent in the integrated design philosophy.

The integrated lablight provides shadow free lighting of various intensities along with air outlets and locations for a wide variety of other ceiling mounted devices. This improves facility installations by ensuring the design intent is not compromised through unintended air outlet or lighting locations; the ceiling device locations are built in to the integrated lablight so the design intent is correctly applied every time.

The integrated lablight is comprised of light fixtures designed to provide various levels of shadow free light on a work surface along with air outlets for room temperature control and ventilation. The top surface and central structure are joined with a bottom plate to form a rigid, air tight structure. An air supply duct connection point in the center of the upper portion routes air through a flow straightener then an adjustable flow splitter. The air then flows around the central light fixture and out through a series of slots arranged symmetrically perpendicular to the fixture axis. The air slots are designed to minimize turbulence and eddies while promoting air mixing for temperature stability. The airflow pathway keeps the light lenses free from dust by washing over the lens surfaces. At the fixture perimeter is a dark colored lip to enhance ambient room air mixing with the supply air stream while providing a concealed area for ambient dust collection. This provides protection for the light fixtures and a convenient method of fixture cleaning.

The lighting is designed to provide consistent, uniform and shadow free lighting at a work surface below. Two or three lighting locations within the fixture minimize the opportunities for shadows on work surfaces. Also, the lighting type and strength may be configured for many specific job applications. A variety of lighting types, lenses and diffusers, reflector shapes and designs are matched to client requirements including fluorescent multiple tube fixtures, LED (light emitting diode), sodium, incandescent, and metal halide.

The integrated lablight attaches to the ceiling structure (Sheetrock® (e.g. drywall or plaster wallboard) or suspended ceilings) for a sealed air tight installation. The lighting equipment (including ballasts, transformers, etc.) is located in the upper area for cooling by ambient plenum air above the ceilings. A variety of electrical power connection locations provide flexibility in tightly constrained ceiling spaces. The designated locations for mounting other ceiling devices frees up maintenance accessibility for faster diagnostics, problem resolutions and future facility modifications. The integrated temperature sensor locations accommodate stable lab environmental controls with locations for ambient and supply air temperature sensors. The overall integrated design philosophy saves equipment, installation, and operating costs and results in safer labs.

A variable air volume (VAV) hood control systems are common because they provide the most value in a market of increasing energy costs. The resultant dynamic conditions may contribute to hood challenges and must be considered in the design process. Occupant thermal comfort may be impacted when the control system compensates for rapid changes in airflow requirements, because the reheat water valve may not respond quickly enough. When a VAV hood sash is opened, the supply and exhaust air flows increase rapidly to compensate for the sudden demand. Lab personnel may be subjected to colder than normal air unless the heating hot water valve anticipates the increased supply air flow rate. The correct amount of heating hot water supply is best determined from diffuser discharge air temperature measurement in addition to room ambient temperature. The integrated lablight provides engineered mounting locations to ensure proper temperature control measurement of supply air temperature and ambient room temperature. The integrated design removes the opportunities for unplanned changes in device location in the construction phase of facility procurement, so the designer's intent is guaranteed to be implemented for increased safety and effectiveness.

In accordance with one embodiment, a ceiling mounted sealed fixture that enhances safety by providing designers with lighting in combination with a uniform, even, and optimized air flow source, and a mounting location for other ceiling devices; this arrangement supports an integrated design approach that results in minimizing cross drafts to facilitate the containment of hazardous substances; optimizing maintenance access by reducing ceiling space constraints, provide uniform lighting with a minimum of shadows, and saving capital and operating costs for building owners; the combining of lighting with air vents enables HVAC designers to use space over tabletops for air registers to optimize room level airflow patterns without sacrificing lighting quality; the multiple light sources inherent in the integrated lablight represent an improvement over current lighting designs by providing uniform light intensity while minimizing worksurface shadows; the integrated lablight fixture provides precise locations for temperature control sensors, which promotes improved temperature stability for temperature sensitive equipment located below the fixture; for rooms with significant containment exhaust requirements, the fixture (lighting and supply air outlet) is designed to be located along the lab's central axis to create a sweeping airflow from center of the lab to the perimeter; the linear shape of the fixture enables their alignment in a row along the center of a lab to maximize the overall room airflow patterns and ambient air mixing; for rooms with excessive heat generating equipment, the fixture can be used in the exhaust mode; an integrated fixture that provides a room side means of adjustment for overall airflow and symmetry of airflow; the use of CFD analysis to optimize the surface features of the air vent design to achieve desired room level airflow patterns; fluorescent tube T-5 fixture with reflector (parabolic, non-linear or other type) and/or luminare lens to optimize lighting uniformity or focus over desired surfaces; CFD (compact fluorescent device) instead of fluorescent tube in item 1 g; LED instead of fluorescent in item 1 g; light lens remains dust free with layer of supply airflow, and a perimeter ambient air guide trough promotes the cleanliness of the fixture and lighting lenses by intercepting any room dust or debris due to the aerodynamic design; an airflow exit slot designs and exit velocities are designed to deliver low speed, uniform airflow with any potential eddies oriented in the axial direction to minimize eddies in the transverse direction. This arrangement allows optimized room level airflow patterns when the fixtures are mounted in a central line; it promotes strong and consistent room air mixing for temperature stability while minimizing cross drafts, which may impair the operation of hoods; and fixture housing provides a seal at the ceiling level to minimize unwanted air transfer between the room and the adjacent areas; fixture design can support a dimmable lighting system with remote control connection points.

In accordance with a further embodiment, a fixture for suspended ceiling systems, comprising Sheetrock® (e.g. drywall or plaster wallboard) or other ceilings that improves overall above ceiling access by providing integral locations for many common ceiling mounted devices; a fixture that eliminates the design conflict between providing air supply and lighting over lab tables; a fixture that provides mounting points for room air and supply air temperature sensors, air quality sensors such as $CO_2$, $O_2$, VOC and other detectors, optical and acoustic sensors, radiation and other sensors, sprinkler heads, pressure ports, and environmental monitoring devices; another advantage of the present invention is the arrangement options for locations of electrical connections. The electrical power for the fixture can be connected on the top or the side of the fixture; the low profile and truncated corner edges enable the integrated lablight to be applied in installations with extreme space limitations.

In accordance with another embodiment, a fixture that saves building owner's money by: eliminating the installation and material handling costs of the air vent (connection costs are retained); minimizes air balancing and commissioning costs associated with non-optimized room level airflow patterns; generally reduces maintenance costs and maintenance response times by improving access to above ceiling devices; reducing costs for installing controls and sensors due to ceiling mounted location with no trim requirements a fixture that saves energy by minimizing airflow increases required for improving hood containment due to excessive room cross drafts, and by providing energy efficient lighting cooled by ceiling plenum air; low profile saves costs with less material used in fabrication; fixture material is predominantly recycled and recyclable; other applications include any room where airflow patterns are critical to the functioning of the facility; other applications include rooms where ceiling space is limited; other applications include rooms where ventilation and lighting are both needed in the same location.

In accordance with a further embodiment, a ceiling mounted fixture comprises: at least one longitudinal arrangement of at least one air vent adapted to receive an air supply; and at least two longitudinal arrangements of at least one light source, and wherein the at least one longitudinal arrangement of at least one air vent is positioned between the at least two longitudinal arrangements of light sources.

In accordance with another embodiment, a fixture comprises: a central light source; an air supply duct having a connection point in a center portion of the fixture; and a flow straightener, wherein the flow straightener routes an air supply through an adjustable flow splitter and around the central light source and out through a series of slots arranged symmetrically perpendicular to an axis of the fixture.

In accordance with a further embodiment, a ceiling mounted fixture system adapted to be located along a lab's central axis to create a sweeping airflow from a center portion of the lab to a perimeter thereof comprises: a plurality of linear fixtures comprising: a central light source; an air supply duct having a connection point in a center portion of the fixture; and a flow straightener, wherein the flow straightener routes an air supply through an adjustable flow splitter and around the central light source and out through a series of slots arranged symmetrically perpendicular to an axis of the fixture; and wherein the plurality of linear fixtures are aligned in a row along the center portion of the lab to maximize the overall room airflow patterns and ambient air mixing.

In accordance with another embodiment, a ceiling mounted fixture comprises: at least one longitudinal arrangement of at least one air vent adapted to receive an air supply; and at least one longitudinal arrangement of at least one light source adjacent to the at least one air vent.

DETAILED DESCRIPTION

Figure 1:
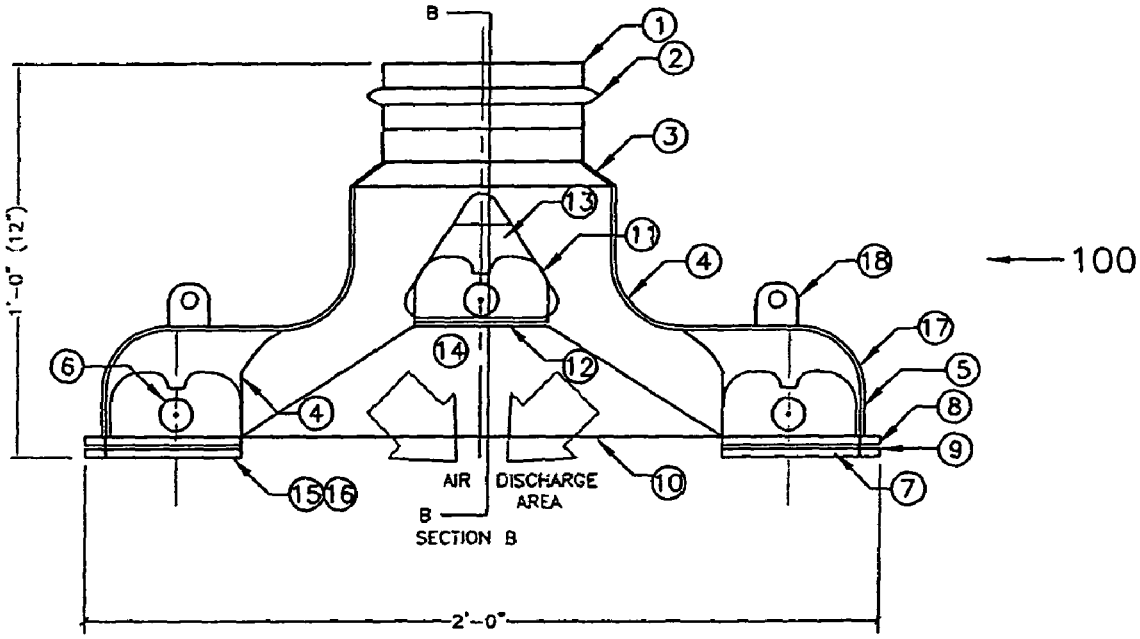
FIG. 1 is a side elevational view of the shorter length, in cross section, showing a suspended laboratory light and ventilation fixture as mounted in a ceiling.

Throughout the following description, specific details are set forth in order to provide a more thorough understanding of the invention. However, the invention may be fabricated without these particulars. In other instances, well known elements have not been shown or described in detail to avoid unnecessarily obscuring the invention. Accordingly, the specification and drawings are to be regarded in an illustrative, rather than a restrictive, sense.

The integrated laboratory light fixture 100 may take form in various components and arrangements of components, and in various steps and arrangements of steps. Slight modifications and variations to fit specific needs of designers are included in this invention. The drawings are only for purposes of illustrating a preferred embodiment and are not to be construed as limiting the invention.

The integrated lablight combines lights and HVAC air outlets to promote lab safety by minimizing hood cross drafts. Usage of the fixture also leads to equipment, installation labor, and energy cost savings for lab owners.

The containment effectiveness of hoods is impaired by cross drafts near the hood face. Good lab designs avoid the placement of supply air outlets near hoods to prevent cross drafts. The air turbulence from cross drafts causes fumes to escape from the hoods, which pose health risks for lab occupants.

Many dense lab layouts arrange the containment devices (fume hoods, exhaust cabinet, etc.) along the perimeter with lab tables in the center. These layouts are best supported with air supply outlets along the central axis of the ceiling to avoid interfering with hood operation. Often this central ceiling space is used for light fixtures over the central tables, and the air outlets are located elsewhere. In addition, other ceiling devices compete with air outlets for best locations, such as fire sprinklers, sensors, detectors, speakers and specialty lights. Additional air outlet location restrictions come from above ceiling maintenance access pathways, which must be left clear to support proper lab operations.

These competing requirements for ceiling space often result in less than optimum air distribution patterns that can interfere with hood containment. Air balancing and commissioning activities may require increases in hood airflow rates to ensure lab safety, which increases energy consumption requirements. Many times proper hood function requires the relocation of some supply air outlets in addition to increasing exhausted air flow quantities. In all cases, reducing laboratory cross drafts improves hood containment effectiveness and enhances safety for the occupants.

New fume hoods that require lower airflow rates are becoming commercially available and offer safe lab designs with less costly facilities. Many low airflow rate containment technologies are sensitive to interferences from cross drafts, so minimizing lab cross drafts will become increasingly important. In these ways, the usage of the Integrated Lab Light will promote lab safety, increase lab energy efficiency, save owners capital costs, and promote the usage of low flow containment devices for life cycle value enhancement.

The integrated lablight presents a relatively inexpensive and easily manufactured fixture which can be fabricated in a variety of different configurations for different design applications. The fabrication strategy focuses on sustainable practices (recyclable, energy efficiency) to provide facility owners with increased choices for environmental responsibility. However, it is to be understood that various changes can be made in the arrangement, form and construction of the apparatus disclosed herein without departing from the spirit and scope of the invention.

FIG. 1 is a side elevational view of the shorter length, in cross section, showing a laboratory light fixture 100 (or lablight fixture) as mounted in a ceiling. The short side of the 2'×4' integrated lablight fixture 100 is shown in FIG. 1. As shown in FIG. 1, the laboratory light fixture 100 includes a top portion preferably comprised of a round sheet metal duct connection, which forms a round duct connection 1 with a beaded collar 2 to secure a supply air flexible duct with a hose clamp. Air flows down the round section through an air flow straightener 3 to promote even air distribution, then into a plenum with an air flow guide 4, which is preferably a curved air guides. On either side of the air outlets, light fixtures are located with reflectors 5, light bulbs 6, and lighting diffusers 7 (or lighting lens).

The integrated lablight can be supported in Sheetrock® (e.g. drywall or plaster wallboard) or T-bar ceilings with a strong gasket and clamped perimeter trim 8. A dark colored perimeter aerodynamic trough 9 (or air ambient air guide) catches ambient room dust and debris to minimize dirt concentrations on the light diffusers 7. The location to mount fire sprinklers or other sensors or devices to the integrated lablight fixture 100 is shown in this view. The air outlets 11 are preferably shaped and oriented to enhance air supply mixing while minimizing room level turbulence and eddy currents.

It can be appreciated that the air outlet orientation is designed to wash the lighting diffusers with supply air, which is usually filtered at the air handler. This shape of the air plenum and lighting diffusers guides the supply air over the interior surfaces which helps keep the light diffusers clean to enhance lighting output. The interior air mixing plenum shape 14 (or air flow mixing area) promotes good room air mixing for ambient room temperature control and stability. The lighting diffuser 12 as shown in FIG. 1 can include an optional third light for higher light output. A central light reflector 5 and a central air flow adjustment guide 13 compensate for any residual eddies resultant from the HVAC air distribution system configurations.

Figure 2:
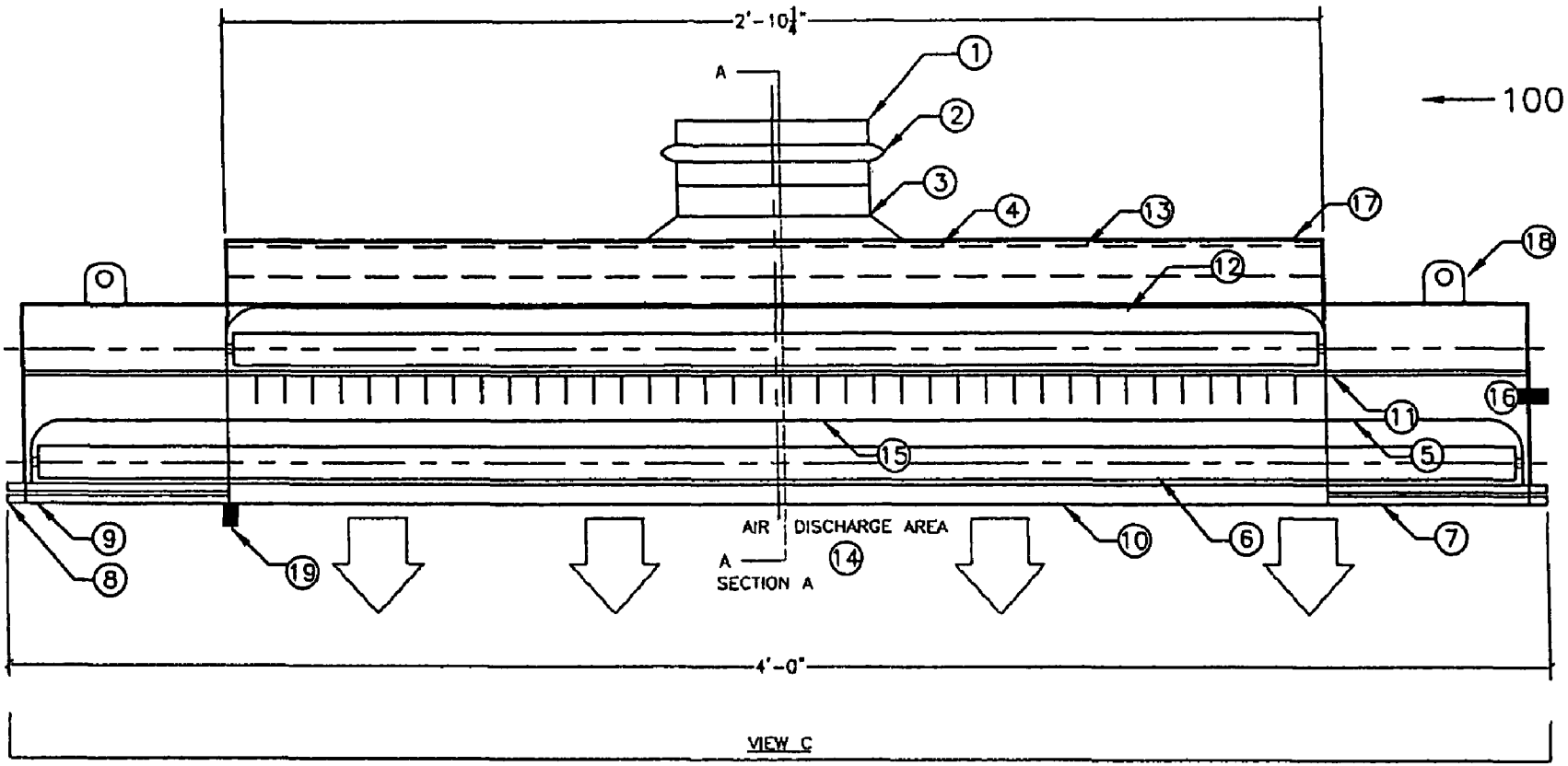
FIG. 2 is a side elevational view of the longer length, in cross section, showing additional details relating to additional ceiling device mounting locations and airflow guide designs.

FIG. 2 is a side elevational view of the longer length, in cross section, showing more details relating to additional ceiling device mounting locations and airflow guide designs. As shown in FIG. 2, the adjustment points for the central air flow adjustment guide include a structural reinforcement 16 to secure the fixture's shape, and a seismic hanger location 17 for code required support. The fixture also preferably includes a unit support hanger flange with an opening 18, which provides structural and/or seismic support.

Figure 3:
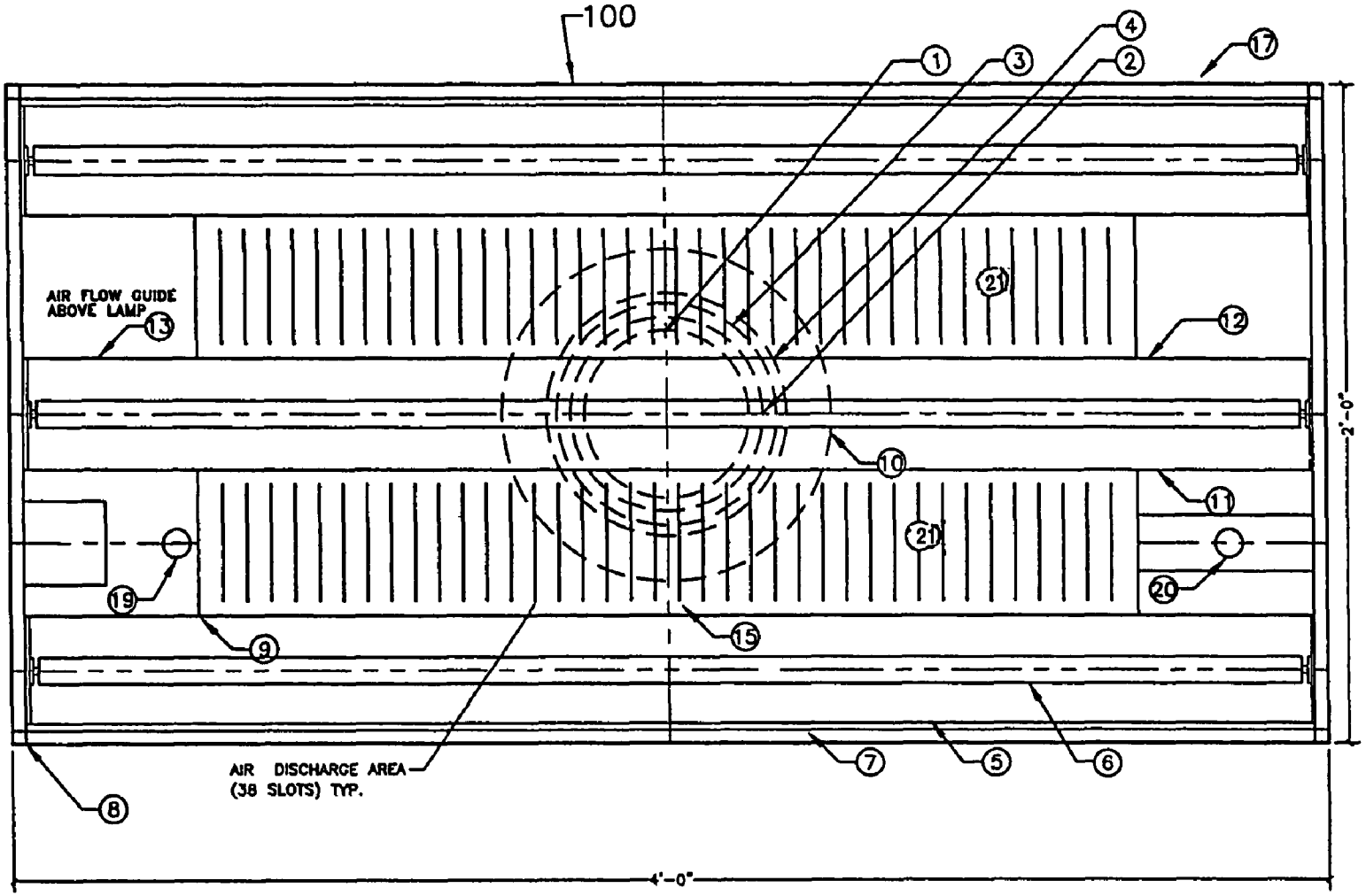
FIG. 3 is a bottom view showing a room side depiction of the laboratory lighting and air outlets and the airflow guiding surfaces.

FIG. 3 is a bottom view showing a room side depiction of the lighting and air outlets and the airflow guiding surfaces. As shown in FIG. 3, the fixture includes at least one row of air vents or air flow guides 4 and at least two rows of light assemblies comprised of a light bulb 6, a light reflector 5, and a light diffuser or light lens 7. The at least one row of air vents or air flow guides 4 are preferably positioned between the at least two rows of light sources. The fixture preferably has a ratio of length to width of approximately 2 to 1. However, it can be appreciated that the length to width ratio can vary from about 8 to 1 (8:1) to about 1 to 1 (1:1), wherein the length and width of the fixture are approximately equal.

As shown in FIG. 3, the fixture 100 preferably includes at least one longitudinal arrangement of at least one air vent 21 adapted to receive an air supply, and at least two longitudinal arrangements of at least one light source 6, wherein the at least one longitudinal arrangement of at least one air vent 21 is positioned between the at least two longitudinal arrangements of at least one light source 6. However, it can be appreciated that the fixture 100 can have 1 to 5 longitudinal arrangements (or rows) of light sources or lights 6 and an equal amount, one more, or one less longitudinal arrangements (or rows) of air vents 21 or air flow guides. In addition, the fixture 100 can include at least one temperature control sensor, which promotes improved temperature stability for temperature sensitive equipment located below the fixture. As shown in FIG. 3, the fixture 100 includes two longitudinal arrangements of air vents 21 and three (3) longitudinal arrangements of light sources 6, in the form of a tubular light.

Figure 4:
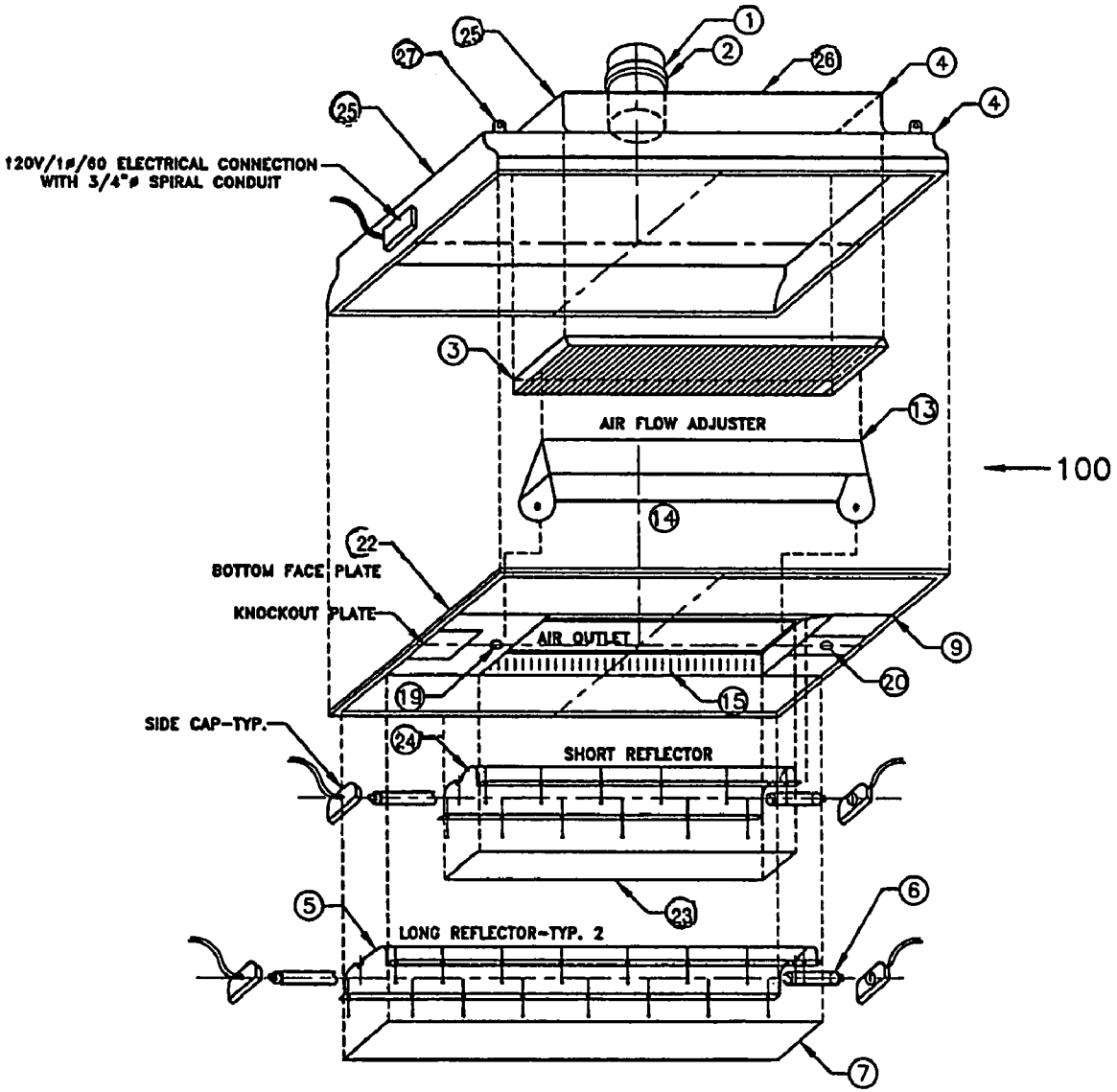
FIG. 4 is an exploded view of a suspended light and ventilation fixture.

FIG. 4 is an exploded view of the suspended light and ventilation fixture 100. As shown in FIG. 4, the fixture 100 includes a duct connection 1, which is preferably round, a beaded collar 2, an air flow straightener 3, an air flow guide 4, a light reflector 5, at least one light bulb 6, a light lens or light diffuser 7, a ceiling support structure 22, an ambient air guide 9, an edge of fixture (in background) 10, an optional third light lens 23, an optional third light reflector 24, an air flow adjustment guide 13, an air flow mixing area 14, a plurality of air flow discharge slots 15, an air flow guide 25, an edge of fixture 26, a structural/seismic support 27, a sprinkler head location or ambient sensor location 19, and a supply air sensor 20. The fixture 100 also includes a structural/seismic support location, a central air flow adjustment guide, and an electrical connection, which is preferably a 120 volt/1 inch/60 watt electrical connections with ¾ inch spiral conduit. However, it can be appreciated that any suitable electrical connection can be used. The fixture 100 is preferably constructed of aluminum or other suitable material, which can be recycled or constructed of a material, which is recyclable.

It can be appreciated that a plurality of integrated laboratory light fixtures 100 can be used to supply an airflow, discharge an airflow, and control an ambient airflow, wherein the ambient airflow is room air that comes in from the side and mixes with the supply air to help maintain overall room temperature uniformity. The fixture 100 is preferably adapted to be located along a clean room's central axis to create a sweeping airflow from center of the lab to the perimeter. In accordance with one embodiment, an array of fixtures 100 can be aligned in a row along the center of a lab to maximize a room's airflow patterns and ambient air mixing. Alternatively, it can be appreciated that the fixture 100 can be used in the exhaust mode for rooms with excessive heat generating equipment. In accordance with another embodiment, the fixture 100 further provides a perimeter ambient air guide trough, which promotes the cleanliness of the fixture 100 and lighting lenses by intercepting any room dust or debris due to the aerodynamic design. In addition, the fixture 100 can include an airflow exit slot designs and exit velocities are designed to deliver low speed, uniform airflow with any potential eddies oriented in the axial direction to minimize eddies in the transverse direction.

In accordance with a further embodiment, the fixture 100 can include mounting points for room air and supply air temperature sensors, air quality sensors such as $CO_2$, $O_2$, VOC and other detectors, optical and acoustic sensors, radiation and other sensors, sprinkler heads, pressure ports, and environmental monitoring devices.

Various other objectives, advantages, and features of the present invention will become readily apparent from the ensuing detailed description, and the novel features will be particularly pointed out in the appended claims. As shown in FIGS. 1-4, the following reference numbers correlate to the following elements:

1—Round duct connection
2—Beaded Duct Collar
3—Air Flow Straightener
4—Air Flow Guide
5—Light reflector
6—Light bulb or lamp
7—Light Lens/diffuser
8—Ceiling support structure
9—Ambient air guide
10—Edge of fixture (in background)
11—Optional third light lens
12—Optional third light reflector
13—Air flow adjustment guide
14—Air flow mixing area
15—Air flow discharge slots
16—Air flow guide
17—Sheet metal shroud
18—Unit Support Hanger Flange with hole
19—Sprinkler head location or ambient sensor location
20—Supply Air Sensor Location It will be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

What is claimed is:

1. A fixture comprising:

a central light source;

an air supply duct having a connection point, in a center portion of the fixture;

a flow straightener, wherein the flow straightener routes an air supply through an adjustable flow splitter and around the central light source and out through a series of slots arranged symmetrically perpendicular to an axis of the fixture;

at least one light source on an outer edge of each of the series of slots arranged symmetrically perpendicular to the axis of the fixture, and wherein the central light source is shorter in length than the at least one light source on the outer edge of each of the series of slots; and an air mixing zone, which receives the air supply from an adjustable flow splitter, the air mixing zone located beneath the central light source and between the at least one light sources.

2. The fixture of claim 1, further comprising a dark colored lip at a perimeter of the fixture to enhance ambient room air mixing with a supply air stream while providing a concealed area for ambient dust collection.

3. A ceiling mounted fixture comprising:

at least two longitudinal arrangements of at least one air vent adapted to supply air to a room;

a central light source located between the at least two longitudinal arrangements of at least one air vent;

a longitudinal arrangement of at least one light source located on an outer edge of each of the at least two longitudinal arrangements of at least one air vent; and a flow straightener, which routes the air supply through an adjustable flow splitter and around the central light source into an interior air mixing plenum, and wherein the interior air mixing plenum is located beneath the central light source and between the longitudinal arrangements of at least one light source.

4. The fixture of claim 3, wherein each of the at least one light sources comprise a light reflector, a light bulb and a light diffuser or lens.

5. The fixture of claim 3, wherein a ratio of a length of the fixture to a width of the fixture is approximately 2 to 1.

6. The fixture of claim 3, further comprising at least one temperature control sensor, which promotes improved temperature stability for temperature sensitive equipment located below the fixture.

7. The fixture of claim 3, wherein the fixture is adapted to be located along a room's central axis to create a sweeping airflow from center of the room to the perimeter.

8. The fixture of claim 3, further comprising a linear array of fixtures, wherein the linear array of fixtures enables their alignment in a row along the center of a lab to maximize a room's airflow patterns and ambient air mixing.

9. The fixture of claim 3, wherein the fixture can be used in an exhaust mode for rooms with excessive heat generating equipment.

10. The fixture of claim 3, further comprising a dark colored perimeter ambient air guide trough having an aerodynamic design that promotes the cleanliness of the fixture and lighting lenses by intercepting any room dust or debris.

11. The fixture of claim 3, further comprising an airflow exit slot designed to deliver low exit speeds and uniform airflow, with any potential eddies oriented in the axial direction to minimize eddies in the transverse direction.

12. The fixture of claim 3, further comprising mounting points for room air and supply air temperature sensors, air quality sensors, optical and acoustic sensors, radiation sensors, sprinklerheads, pressure ports, and environmental monitoring devices.

13. The fixture of claim 3, further comprising an electrical connection, wherein the electrical connections for electrical power for the fixture can be connected on the top or the side of the fixture.

14. The fixture of claim 3, wherein the fixture is comprised of material, which is predominantly recycled and recyclable.

15. The fixture of claim 3, wherein the at least one light sources is a fluorescent tube.

16. The fixture of claim 3, wherein the at least one light source is at least one LED.

17. The fixture of claim 3, wherein the fixture has a central axis, and further comprising at least one sensor located on at least one end of the fixture's central axis.

18. The fixture of claim 3, wherein each of the at least two longitudinal arrangements of at least one air vent adapted to supply air to a room further include a series of slots symmetrically positioned perpendicular to an axis of the ceiling mounted fixture.

19. The fixture of claim 3, further comprising a duct connection adapted to connect to an airflow source.

20. The fixture of claim 19, wherein the flow straightener receives the air supply from the duct connection.

21. A ceiling mounted fixture system adapted to be located along a lab's central axis to create a sweeping airflow from a center portion of the lab to a perimeter thereof comprising:

a plurality of linear fixtures comprising:

a central light source;

an air supply duct having a connection point in a center portion of the fixture;

a flow straightener, wherein the flow straightener routes an air supply through an adjustable flow splitter and around the central light source and out through a series of slots arranged symmetrically perpendicular to an axis of the fixture;

at least one light source on an outer edge of each of the series of slots arranged symmetrically perpendicular to the axis of the fixture; and an interior air mixing plenum located beneath the central light source and between the at least one light source on an outer edge of each of the series of slots arranged symmetrically perpendicular to the axis of the fixture; and wherein the plurality of linear fixtures are aligned in a row along the center portion of the lab to maximize the overall room airflow patterns and ambient air mixing.

* * * * *